United States Patent [19]

Madore et al.

[11] Patent Number: 4,846,982

[45] Date of Patent: Jul. 11, 1989

[54] PARTICULATE FABRIC LAUNDERING COMPOSITION

[75] Inventors: Linda M. Madore; Alan Zombeck, both of Midland, Mich.

[73] Assignee: Dow Corning Corporation, Midland, Mich.

[21] Appl. No.: 251,285

[22] Filed: Sep. 30, 1988

[51] Int. Cl.[4] ..... D06M 00/00

[52] U.S. Cl. ..... 252/8.75; 252/8.6; 252/8.8

[58] Field of Search ..... 252/8.8, 8.75

[56] References Cited

U.S. PATENT DOCUMENTS

| | | | |
|---|---|---|---|
| 3,402,192 | 9/1968 | Haluska | 556/437 |
| 3,936,537 | 2/1976 | Baskerville et al. | 427/242 |
| 4,741,842 | 5/1988 | Adams | 252/8.75 |

FOREIGN PATENT DOCUMENTS 1549180 7/1979 United Kingdom .

*Primary Examiner*—A. Lionel Clingman
*Attorney, Agent, or Firm*—Jim L. DeCesare

[57] ABSTRACT

A particulate fabric laundering detergent formulation in which there is included at least one organic surfactant selected from the group consisting of anionic, nonionic, ampholytic, and zwitterionic compounds and mixtures thereof, at least one detergent builder selected from the group consisting of inorganic and organic water soluble builder salts, water insoluble builder salts, and seeded builders, and a mixture of a water dispersible fabric softening conditioning compound, a polydimethylsiloxane polymer, and a polyoxyalkylene siloxane copolymer.

16 Claims, No Drawings

PARTICULATE FABRIC LAUNDERING COMPOSITION

BACKGROUND OF THE INVENTION

This invention relates to a fabric softening composition and to a particulate laundering product including the softener.

A fabric softener is a dilute solution or dispersion of a quaternary ammonium derivative used to treat fabrics in the final rinse of a laundering process in order to make the fabrics feel softer. In addition to softness, fabric softeners are known to also provide static control. Because of the affinity of quaternary ammonium compounds for negatively charged surfaces, their single largest market has been as fabric softeners. Commercial fabric softeners generally include about a four to eight percent dispersion of quaternary ammonium compound which is added to the rinse cycle of the washing process. The quaternary ammonium compound can also be applied to a nonwoven sheet or a polyurethane foam which is added with wet clothes in a dryer. Such sheets contain a fatty acid ester which allows the quaternary ammonium compound to transfer from the sheet to the clothes in the dryer during the drying cycle. Recently, there have been devised combined detergent and softener formulations which allow introduction of all additives in the wash cycle.

Modern washing machines work automtically and the operator places the laundry in the machine, pours in the detergent, and sets the controls. One set of controls determines whether the machine employs hot, warm, or cold water. Water enters the machine through hoses connected to the hot and cold water pipes. The operator also sets controls in order to select the length of washing and rinsing time, and the amount of water that enters the machine. The machine is powered by an electric motor and includes a filter that removes lint, and automatic dispensers for bleach and fabric softeners. A wash cycle typically includes four stages. In the wash cycle, after water fills the wash tub, an agitator reverses direction alternately and moves the laundry through the water and detergent, and forces water through the items of laundry. The washer is then emptied of all of the wash liquor in the spin cycle and the clothes are spun to remove excess water. In the rinse cycle, clean water is added along with the fabric softener and the clothes are again agitated. The washer is emptied of rinse liquor and the clothes are spun in a final spin cycle during which time excess water is removed and pumped out of the machine through a drain hose. The clothing is then ready to be removed from the machine and dried in a dryer or hung on a clothesline until dry.

Fabric softeners for use in such machines are well known in the art. For example, in British Patent No. 1,549,180, issued July 25, 1979, Dumbrell et al disclose a fabric softener which includes, in addition to the softening benefit, the additional benefits of easier ironing, antistatic properties, pleasanter feel, and soil release properties. The additional benefits are stated to be derived from the inclusion along with a cationic quaternary ammonium fabric softening agent, of a silicone compound which is said to be an aqueous emulsion of a linear siloxane.

Specifically, Dumbrell et al relate to fabric softening compositions that include an aqueous dispersion of a cationic softening compound, and a silicone emulsion.

The cationic compound is disclosed to be one or more or mixtures of a combination of quaternary monoammonium compounds such as tallowtimethylammonium chloride, and ditetradecyldimethylammonium chloride; quaternary imidazolinium compounds; polyammonium compounds such as acid salts of diamine compounds, and polyamine salts; and polyalkyleneimine salts. The silicone emulsion is preferably a linear dialkyl or alkylaryl siloxane which may be partially or wholly fluorinated, or substituted with cationic nitrogen groups. The viscosity is disclosed to be, at twenty-five degrees Centigrade, at least one hundred and up to eight thousand centistokes. The weight ratio of siloxane content of the emulsion to the dispersion is five to one, to one to one-hundred. Representative compositions are said to be cationic emulsion polymerized dimethylsiloxanes, with the emulsifying agent being, for example, ditallowyldimethylammonium chloride; quaternized polysiloxanes such as dipyridinium poldimethylsiloxane; and aminofunctional linear polysiloxanes such as polydimethylsiloxanes containing dimethylaminopropyl groups.

A basic distinction should be drawn between a rinse cycle softener and a wash cycle softener. As noted hereinabove, the rinse cycle fabric softener is a liquid dispersion of a quaternary ammonium compund which is added separately to the rinse liquor during the rinse cycle of the laundering device. A powdered wash cycle fabric softener on the other hand is typically in the form of solid particles of the quaternary ammonium compound which are mixed in with the powdered laundry detergent and added to the wash liquor by the homemaker, for example, before initiation of the wash cycle of the fabric laundering device.

Dumbrell et al noted previously relate to the rinse cycle type of fabric softening formulation. Typical of the wash cycle fabric softening variety of product is disclosed in U.S. Pat. No. 4,741,842, issued May 3, 1988, to Adams. In Adams there is described a particulate detergent of an anionic surfactant, a builder salt, and a mixture of a cationic amine softener such as a quaternary ammonium compound and an ethoxylated tertiary amine. The function of the ethoxylated tertiary amine is said to be as a dispersant-softener.

In accordance with the present invention, what has been achieved is that a viable alternative has been discovered for the ethoxylated tertiary amine of Adams in the nature of a particular combination of at least two silicone materials. Thus, a silicone polymer and a silicone copolymer have been combined and substituted for the ethoxylated tertiary amine of Adams. It has been found that such combination disperses the fabric softener active, in both cases the quaternary ammonium compound, and provides an improved delivery of the active component of the softener formulation to the fabrics being treated, with the result that there is provided better softening together with a more pronounced reduction in static. The reduction in static provided by the silicone compounds of the present invention is based on the fact that the fibers of the fabrics are lubricated by the compounds of the present invention with the result that less static is generated. The silicone polymer and the silicone copolymer combination also disperses the active softener component of the formulation to a degree at least equal to or in excess of the ethoxylated tertiary amine (ETA) of Adams since the silicone combination coats the individual particles of the quaternary ammonium compound active component of the wash cycle fabric softener formulation, so that in the wash cycle, the agglomerates of the active component disperse apart one from the other, thus freeing these individual particles to deposit themselves throughout the fabric in a more uniform pattern. Since the fabrics carry a negative charge, the positively charged active component particles are attached thereto. When the fabrics are added to a dryer at the end of the wash cycle, these individual particles are enabled to deposit, melt and spread to a more uniform degree with the silicone combination, providing softer clothes and less static because of the waxy quality of the active component attributed to the clothing or fabrics.

Thus, the concept of the present invention provides new features, benefits and advantages, not taught in the prior art.

SUMMARY OF THE INVENTION

This invention relates to a softening composition for use as an ingredient of a particulate detergent formulation in a fabric laundering operation, and wherein there is provided a mixture of a fabric softening conditioning compound, a polydimethylsiloxane polymer, and a polyoxyalkylene siloxane copolymer.

In some preferred embodiments of the invention, the fabric softening conditioning compound includes a cationic compound selected from the group consisting of quaternary ammonium salts and organic based compounds having $C_{12}$ to $C_{18}$ hydrocarbon chain molecules of amines, esters, acids, or amine oxides. Thus, the fabric softening conditioning compound can be a quaternary ammonium salt compound of distearyl dimethyl ammonium chloride. The weight ratio of the polymer to the copolymer in the mixture is from one to three, to three to one, more preferably one to one. The softening composition contains from two percent to ten percent by weight of the polymer and the copolymer. In the polymer formula x is an integer of about six hundred and the nominal viscosity of the polymer is about five thousand centistokes measured at twenty-five degrees centigrade. The copolymer has a nominal viscosity of about fifteen hundred centistokes measured at twenty-five degrees centigrade.

The present invention is also directed to a particulate fabric laundering detergent formulation in which at least one organic surfactant is selected from the group consisting of anionic, nonionic, ampholytic, and zwitterionic compounds and mixtures thereof, at least one detergent builder is selected from the group consisting of inorganic and organic water soluble builder salts, water insoluble builder salts, and seeded builders, and a mixture of a water dispersible fabric softening conditioning compound, a polydimethylsiloxane polymer, and a polyoxyalkylene siloxane copolymer. In this formulation, there is included from about ninety to about ninety-eight percent by weight of the surfactant and the detergent builder, and from about two to about ten percent by weight of the water dispersible fabric softening conditioning compound, and the polymer and copolymer.

It is therefore an object of the present invention to provide not only a new and novel hitherto unknown type of softening composition, but a detergent formulation including such composition. It has been found that the silicone ingredients of the compositions of the present invention are viable alternatives to the organic dispersant compounds of the prior art, if not in fact, superior thereto.

These and other features, objects, and advantages, of the herein described present invention will become apparent when considered in conjunction with the following detailed description of the invention.

DETAILED DESCRIPTION OF THE INVENTION

Ammonium compounds in which all of the hydrogen atoms on nitrogen have been substituted by alkyl groups are called quaternary ammonium salts. These compounds may be represented in a general sense by the formula:

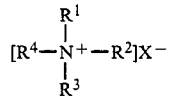

The nitrogen atom includes four covalently bonded substituents that provide a cationic charge. The R groups can be any organic substituent that provides for a carbon and nitrogen bond with similar and dissimilar R groups. The counterion X is typically halogen. Use of quaternary ammonium compounds is based on the hydrophilic portion of the molecule which bears a positive charge. Since most surfaces are negatively charged, solutions, dispersions, and particulate mixtures, of these cationic surface active agents are readily adsorbed to the negatively charged surface, such as fabrics, clothing, and towels.

In accordance with the present invention, the softening agent can include quaternary ammonium salts, and specifically any of the cationic compounds described in British Pat. No. 1,549,180, such as quaternary monoammonium compounds having either two $C_{12}$–$C_{20}$ alkyl chains or one $C_{18}$–$C_{24}$ alkyl chain; quaternary imidazolinium textile softeners; polyammonium compounds; fabric softening polyamine salts; fully substituted polyquaternary compounds; and polyalkylene imine salts. Particular quaternary ammonium compounds suitable for use herein may include, for example, trimethyltallowammonium chloride, trimethylsoyaammonium chloride, trimethylcocoammonium chloride, dimethyldicocoammonium chloride, dimethyldi(hydrogenated tallow)ammonium chloride, trimethyldodecylammonium chloride, trimethyloctadecylammonium chloride, trimethylhexadecylammonium chloride, dimethylalkylbenzylammonium chloride, 1:1 mixture of trimethyltallowammonium chloride and dimethyldicocoammonium chloride, N,N,N′,N′,N′-pentamethyl-N-tallow-1,3-propanediammonium dichloride, methylbis(2-hydroxyethyl)-cocoammonium chloride, methylpolyoxyethylene cocoammonium chloride, methylbis(2-hydroxyethyl)oleylammonium chloride, methylpolyoxyethylene oleyammonium chloride, methylbis(2-hydroxyethyl)oleylammonium chloride, methylbis(2-hydroxyethyl)octadecylammonium chloride, methylpolyoxyethylene octadecylammonium chloride, n-dodecyl tetradecyl dimethylbenzylammonium chloride, n-tetradecyl hexadecyl dimethylbenzylammonium chloride, n-dodecyl tetradecyl dimethyldichlorobenzylammonium chloride, n-octadecyldimethylbenzylammonium chloride, dialkylmethylbenzylammonium chloride, n-dodecyl tetradecyl hexadecyl dimethylbenzylammonium chloride, n-dodecyl tetradecyl hexadecyl dimethylethylbenzylammonium chloride, methyl sulfate quaternary of ethyoxylated tallow diethylenetriamine condensate, methyl sulfate quaternary of propoxylated tallow diethylenetriamine condensate, and 1-(tallow amidoethylene)-2-nor (tallow alkyl)-2-imidazolinium, methyl sulfate quaternary.

The silicone compositions of the present invention have been found to have no negative effect on the rewettability of fabrics treated in a laundry operation. The silicones are delivered to the fabric in the form of granules or particulates. The silicone particulates including the polymer, the copolymer, and the active quaternary ammonium compound, can be used alone or formulated into a fabric conditioning composition, such as a particulate detergent fabric softener. The quaternary ammonium salt based type of fabric softener compound is preferred.

While the following examples are combinations of quaternary based softener compounds with silicone polymers and copolymers, the silicone compositions will improve softening when used in combination with any organic based fabric conditioning compound such as organic conditioning compositions comprised of long hydrocarbon $C_{12}$–$C_{18}$ chain molecules of amines, esters, acids, amine oxides, and derivatives thereof.

The polydimethylsiloxanes used herein can be high molecular weight polymers having a molecular weight in the range from about 200 to about 200,000, and have a viscosity in the range from about 20 to 2,000,000 centistokes, preferably from about 500 to 50,000 centistokes, more preferably from about 3,000 to about 30,000 centistokes measured at 25° C. The siloxane polymer is generally end-blocked either with trimethylsilyl or hydroxyl groups but other end-blocking groups are also suitable. The polymer can be prepared by various techniques such as the hydrolysis of dimethyldihalosilanes and subsequent condensation of the resulting hydrolysis product, or by the cracking and subsequent polymerization of dimethylcyclosiloxanes.

EXAMPLE I

Towels were prepared for treatment by removing the mill textile conditioners applied at the mill during manufacture of the towels. The process was conducted at a commercial laundromat. Bundles of 86:14 cotton polyester terry towels were washed five times with an anionic detergent containing a high level of phosphorus. Detergent remaining in the towels was removed by three final wash and rinse cycles from which detergent was omitted. Each bundle was subjected to eight complete wash and rinse cycles during the stripping process. The treatments were conducted in a Whirlpool Imperial Seventy model washing machine. The Cycle Setting was Heavy/14 minutes. The Cloth to Liquor Ratio was 1:20. The Wash Temperature was Warm (32° C.). The Rinse Temperature was Cold (11° C.). The detergent used was a nonionic-anionic phosphate built detergent at a level of 0.14% by weight. The Dryer was a Whirlpool model with a Dryer Setting of Permanent Press-High Drying, at a time of 60 minutes.

The test used to measure softness was a panel test in which ten to twelve people were asked to rank five to six towels in order of softness. The towels were treated by the method described immediately above. Following treatment, the towels were placed in a constant temperature and humidity room over night to equilibriate and tested the next day. Dryers tend to overdry towels and provide a harsher feel than normal and therefore all towels tested in a given panel were conditioned at the same temperature and humidity before testing. Each test included one control towel. The control towel was a towel which had not been treated by softening agent. Ten to twelve people were asked to evaluate the towels by feeling the towels and choosing the harshest towel, the softest towel and placing the remaining towels in order of increasing softness. The towels were assigned a ranking between one and five to six with the highest value corresponding to the softest towel. Before the test was conducted, each member of the panel was asked to wash their hands to remove any residue which might interfere with the test. During the evaluation, the panel members rewashed their hands to remove any softener buildup. Since the softness of a towel increases with repeated handling, a new surface of each towel was exposed for each panel member, and each towel was replaced after evaluation by three people. The resulting rankings were evaluated using the Student Newman Keuls statistical procedure.

The rewettability or water absorbency of the treated towels was determined by cutting strips of fabric from the towels and measuring the height of migration of a dyed water solution over a specified time. The greater the migration of dye solution up the fabric the better the rewet properties. Food coloring was used as the dye.

The height of migration was measured after the strip had been immersed for four minutes. The variability of this wicking method was determined by using three bundles of twelve towels each treated with a 6% quaternary ammonium salt softener. The rewettability of one towel from each bundle was determined by cutting five strips of fabric from the towel and conducting the wicking test on each strip. The variability of the test method was found to be +/−6.9 mm.

Formulations containing varying amounts of silicone polymer and copolymer were evaluated for softening, static, and rewettability. As noted above, the fabric bundle was treated and with a detergent containing the silicone polymer, copolymer, and the softener active component.

In the following examples, various combinations of ingredients were employed in order to further illustrate the concepts of the present invention. As base detergent, there was selected a nonionic-anionic phosphate built detergent. This base powder was a specially formulated detergent without a softener active ingredient and therefore functioned as the control. In all cases where the base powder was employed in admixture with other ingredients, it constituted 95.57 weight percent of the total amount of formulation employed. Where used as a control, the base powder was employed at a level of one hundred percent. In those instances where the silicone polymer and copolymer were added, these materials were employed at levels of 0.13 percent by weight of total formulation, and in individual ratios with respect to one another varying from one to three, to three to one. The level of 0.13 percent by weight was maintained even where one silicone compound was added to the exclusion of the other. Except for the control composition of base powder, all test runs included the remainder of 4.3 percent by weight of fabric softener active ingredient. It is noted that in the several treatments conducted in each instance, that the ratios of the silicone copolymer to silicone polymer was respectively, 75:25, 50:50, and 25:75.

Each of the formulations employed included 4.3 percent distearyl dimethylammonium chloride(DDMAC), the active ingredient of a quaternary ammonium salt commercial fabric softener solid, manufactured by Sherex Chemical Company, Dublin, Ohio, as AROSURF® TA-100, a trademark of that company; together with varying amounts of the silicone composition of the present invention as noted above. The silicones and the quaternary ammonium salt softener were prepared by melting the components together. The mixture was then allowed to cool. After cooling, the mixture was granulated into powder form. A series of five treatments were conducted, and evaluations were made following the first, third, and fifth treatments. Average softness rankings are set forth below.

EXAMPLE II

Into a beaker was added the silicone polymer of the present invention, the silicone copolymer, and DDMAC, each individually and in the amounts and ratios indicated above. The ingredients were mixed while heat and agitation were applied and the beaker was allowed to cool. The resulting fabric softening mixture was then regranulated into small particles and sieved to between twenty to one hundred mesh size.

EXAMPLE III

Example II was repeated except that the procedure for the addition of the various components was altered. In this example, the silicone polymer and the silicone copolymer were first each mixed together one with the other in order to form a uniform silicone blend. The silicone blend of the polymer and copolymer was then added to DDMAC in a beaker, and the mixture was heated and agitated with stirring. The beaker was allowed to cool, and the contents were regranulated and sieved as in Example II.

In panel tests as outlined above in Example I, the panelists overwhelmingly chose towels treated in accordance with the procedure of Example III as being softer than those treated in accordance with the procedure of Example II after one and three treatments, and therefore, the procedure of Example III was employed and repeated in collecting the data shown hereinafter.

EXAMPLE IV

The procedure of Example III was repeated in order to prepare the softener formulations, and the formulations together with the base powder were tested for softness in accordance with the steps outlined in Example I. The results are shown in Table I.

TABLE I

| | Ingredients (WT. %/Ratio) | | | Treatment | | |
|---|---|---|---|---|---|---|
| Base | QUAT DDMAC | Silicone Copolymer* | Silicone Polymer* | No. I | No. III | No. V |
| 95.57 | 4.3 | 75 | 25 | 4.8 | 4.8 | 4.9 |
| 95.57 | 4.3 | 50 | 50 | 4.6 | 4.6 | 4.3 |
| 95.57 | 4.3 | 25 | 75 | 3.9 | 4.1 | 4.3 |
| 95.57 | 4.3 | — | 100 | 3.2 | 3.2 | 3.7 |
| 95.57 | 4.3 | 100 | — | 2.9 | 2.7 | 2.7 |
| 100 | — | — | — | 1.4 | 1.3 | 1.1 |

*Ratios of copolymer to polymer at a total level of 0.13 weight percent.

Example IV was repeated, and a second set of data were collected and are shown in Table II.

TABLE II

| | Ingredients (WT. %/Ratio) | | | Treatment | | |
|---|---|---|---|---|---|---|
| Base | QUAT DDMAC | Silicone Copolymer* | Silicone Polymer* | No. I | No. III | No. V |
| 95.57 | 4.3 | 25 | 75 | 5.6 | 4.7 | 3.3 |
| 95.57 | 4.3 | 50 | 50 | 4.9 | 4.9 | 5.0 |
| 95.57 | 4.3 | 75 | 25 | 3.3 | 3.7 | 3.6 |
| 95.57 | 4.3 | — | 100 | 2.9 | 2.6 | 3.9 |
| 95.57 | 4.3 | 100 | — | 2.2 | 3.8 | 3.7 |
| 100 | — | — | — | 1.9 | 1.1 | 1.4 |

*See Table I

Tables I and II in particular indicate that combinations of both the polymer and copolymer provide a synergistic effect when compared to the effect obtained by the use of either individually.

EXAMPLE V

Example IV was repeated except that there was also included comparative testing based on the ethoxylated tertiary amine softener composition of U.S. Pat. No. 4,741,842, which is referred to in the following tables as ETA. ETA is approximately eighty-eight percent by weight quaternary ammonium compound and eight percent by weight of ethoxylated amine. In this example, rewettability as well as static control were tested in addition to softness. The results indicate that the compositions of the present invention provide equal if not better softness benefits than ETA, preferential static control, and do not have a negative effect on fabric rewettability.

TABLE III

| | Ingredients (WT. %/Ratio) | | | Treatment | | |
|---|---|---|---|---|---|---|
| Base | QUAT DDMAC | Silicone Copolymer* | Silicone Polymer* | No. I | No. III | No. V |
| 95.57 | 4.3 | 25 | 75 | 4.4 | 3.4 | 3.2 |
| 95.57 | 4.3 | 50 | 50 | 3.9 | 3.4 | 4.5 |
| 95.57 | 4.3 | 75 | 25 | 2.5 | 4.4 | 3.4 |
| 95.12 | 4.88** | — | — | 2.3 | 1.9 | 2.6 |
| 100 | — | — | — | 1.7 | 1.7 | 1.6 |

*See Table I
**ETA =substituted for DDMAC.

The procedure for Table III was repeated and a second set of data generated and set forth in Table IV.

TABLE IV

| | Ingredients (WT. %/Ratio) | | | Treatment | | |
|---|---|---|---|---|---|---|
| Base | QUAT DDMAC | Silicone Copolymer* | Silicone Polymer* | No. I | No. III | No. V |
| 95.57 | 4.3 | 25 | 75 | 5.0 | 4.4 | 4.4 |
| 95.57 | 4.3 | 50 | 50 | 3.2 | 4.3 | 3.6 |
| 95.57 | 4.3 | 75 | 25 | 2.1 | 2.6 | 3.1 |
| 95.12 | 4.88** | — | — | 3.1 | 2.5 | 2.7 |
| 100 | — | — | — | 1.4 | 1.0 | 1.0 |

*See Table I.
**ETA substituted for DDMAC.

TABLE V

| | Ingredients (WT. %/Ratio) | | | Rewettability (mm/4 min.) | | |
|---|---|---|---|---|---|---|
| Base | QUAT DDMAC | Silicone Copolymer* | Silicone Polymer* | No. I | No. III | No. V |
| 95.57 | 4.3 | 50 | 50 | 67 | 79 | 80 |
| 95.57 | 4.3 | 25 | 75 | 67 | 84 | 84 |
| 95.57 | 4.3 | 75 | 25 | 62 | 80 | 80 |
| 95.12 | 4.88** | — | — | 69 | 84 | 84 |

TABLE V-continued

| Ingredients (WT. %/Ratio) | | | | Rewettability (mm/4 min.) | | |
|---|---|---|---|---|---|---|
| Base | QUAT DDMAC | Silicone Copolymer* | Silicone Polymer* | No. I | No. III | No. V |
| 100 | — | — | — | 67 | 83 | 83 |

*See Table I.
**ETA substituted for DDMAC.

TABLE VI

| Ingredients (WT. %/Ratio) | | | | Rewettability (mm/4 min.) | | |
|---|---|---|---|---|---|---|
| Base | QUAT DDMAC | Silicone Copolymer* | Silicone Polymer* | No. I | No. III | No. V |
| 95.57 | 4.3 | 50 | 50 | 66 | 81 | 82 |
| 95.57 | 4.3 | 25 | 75 | 70 | 80 | 85 |
| 95.57 | 4.3 | 75 | 25 | 75 | 81 | 80 |
| 95.12 | 4.88** | — | — | 79 | 83 | 83.5 |
| 100 | — | — | — | 74 | 78 | 78.5 |

*See Table I.
**ETA substituted for DDMAC.

It should be apparent from the foregoing tables that the softener ingredient containing the compositions of the present invention imparted the best softness. Specifically, combinations of the copolymer and the polymer exhibited a synergistic effect in comparison to the effect obtained when either was used without the other. The rewettability of each of the foregoing is set forth, and it should be pointed out, that the average rewettability imparted to each fabric was not negatived by the softeners including the compositions of the present invention.

EXAMPLE VI

The compositions of the present invention were evaluated for their ability to reduce static electricity. The material ETA of Example V was again included for comparative purposes. The fabric bundle used to conduct this test consisted of the following garments or equivalent in yard goods:

10% 100% Nylon Tricot
10% 100% Polyester
12% 100% Acrylic
4% 100% Rayon
4% 100% Acetate
28% 65/35 Polyester/Cotton
32% 86/14 Cotton/Polyester Towels Bundles were stripped before use by washing in hot water five times with an anionic phosphate built detergent and then rinsed three times without any detergent, as noted in Example I.

After treating the bundles with the detergent and softening mixture in the wash, the bundles were dried in dryers wiped with isoproponal to remove any previous residue. The bundles were dried for 60 minutes. Each piece of fabric was taken out one at a time. Different fabrics were brought together and separated to observe static and cling. Rubber Gloves were used to eliminate any dissipation of static. The entire bundle was rated according to the following scale:

1 None-No items affected by static; no detectable cling.

2 Very Light-Very slight attraction when swatches are brought together (no readably observable cling), slight static.

3 Light-Some static, very little cling.

4 Light Moderate-Definite cling and static ($\frac{1}{3}$ synthetics).

5 Moderate-$\frac{1}{4}$ of items affected by cling and static ($\frac{2}{3}$ synthetics).

6 Moderate Heavy-Same as above, but more intense.

7 Heavy-$\frac{1}{2}$ of items affected by cling and static (all synthetics).

8 Very Heavy-Same as above but more intense.

9 Severe-$\frac{3}{4}$ or more of items affected (all synthetics and other items).

At least two people were used to rate the static out of the dryer. The average of the two was recorded as the static rating for the particular bundle.

The results of the static tests are shown below in Tables VII and VIII, and it can be seen that the compositions of the present invention were at least three times more effective than the prior art material ETA.

TABLE VII

| Ingredients (WT. %/Ratio) | | | | Static Rating | | |
|---|---|---|---|---|---|---|
| Base | QUAT DDMAC | Silicone Copolymer* | Silicone Polymer* | No. I | No. III | No. V |
| 95.57 | 4.3 | 50 | 50 | 2 | 2.5 | 2.5 |
| 95.57 | 4.3 | 25 | 75 | 2 | 1.5 | 2 |
| 95.57 | 4.3 | 75 | 25 | 2.5 | 2 | 2.5 |
| 95.12 | 4.88** | — | — | 6 | 7 | 8 |
| 100 | — | — | — | 7 | 7 | 6 |

*See Table I.
**ETA substituted for DDMAC.

TABLE VIII

| Ingredients (WT. %/Ratio) | | | | Static Rating | | |
|---|---|---|---|---|---|---|
| Base | QUAT DDMAC | Silicone Copolymer* | Silicone Polymer* | No. I | No. III | No. V |
| 95.57 | 4.3 | 50 | 50 | 1.5 | 1.5 | 1.5 |
| 95.57 | 4.3 | 25 | 75 | 2.5 | 2 | 2 |
| 95.57 | 4.3 | 75 | 25 | 2 | 2 | 3 |
| 95.12 | 4.88** | — | — | 7 | 7.5 | 7 |
| 100 | — | — | — | 7 | 8 | 8 |

*See Table I.
**ETA substituted for DDMAC

Surfactants preferred in accordance with the present invention are anionic and nonionic, and mixtures thereof. Specific anionic surfactants are, for example, carboxylic acids and salts; sulfonic acids and salts such as alkylbenzenesulfonates, alkylarylsulfonates, naphthalenesulfonates, petroleum sulfonates, sulfonates with ester, ether, or amide linkages, and lignosulfonates; sulfuric acid esters and salts such as sulfated alcohols, ethoxylated and sulfated alcohols and alkylphenols, sulfated acids, amides, and esters, and sulfated natural fats and oils; and phosphoric and polyphosphoric acid esters and salts such as alkoxylated and phosphated alcohols and phenols. Among the category of nonionic surfactants which can be employed are, for example, ethoxylated alcohols; ethoxylated alkylphenols; ethoxylated carboxylic esters such as glycerol esters, polyethylene glycol esters, anhydrosorbitol esters, ethoxylated anhydrosorbitol and sorbitol esters, ethoxylated natural fats and oils, ethylene and diethylene glycol esters, and propanediol esters; and ethoxylated carboxylic amides.

Various category of builders can be employed exemplary of which are, for example, phosphates such as pentasodium phosphate, sodium tripolyphosphate, tetrasodium pyrophosphate, trisodium phosphate, sodium polymetaphosphate, and potassium phosphates; sodium carbonate; silicates; zeolites; clays; nitrilotriacetic acid; and alkalies. In addition, those builders as well as surfactants set forth in U.S. Pat. No. 3,936,537, issued Feb. 3, 1976, as well as in U.S. Pat. No. 4,741,842, issued May 3, 1988, may be employed herein.

The silicone copolymers of the present invention and methods for their preparation are described in U.S. Pat. No. 3,402,192, issued Sept. 17, 1968, which is incorporated herein by reference. Generically, such materials are described as a copolymer selected from the group consisting of copolymers having the average structural formulae:

(1) $R_aSi[(OSiMe_2)_n(OSiMeG)_dOSiMe_2G]_{4-a'}$ (2) $GMe_2Si(OSiMe_2)_n(OSiMeG)_bOSiMe_2G$, (3) $Me_3Si(OSiMe_2)_n(OSiMeG)_cOSiMe_3$, and (4) $R_aSi[(OSiMe_2)_n(OSiMeG)_cOSiMe_3]_{4-a'}$ in which formulae R is a hydrocarbon radical free of aliphatic unsaturation and contains from 1 to 10 carbon atoms, Me is a methyl radical, G is a radical of the structure $—D(OR'')_mA$ wherein D is an alkylene radical containing from 1 to 30 carbon atoms, R'' is composed of ethylene radicals and radicals selected from the group consisting of propylene and butylene radicals, the amount of ethylene radicals relative to the other alkylene radicals being such that the ratio of carbon atoms to oxygen atoms in the total OR'' blocks ranges from 2.3:1 to 2.8:1, m has an average value from 7 to 100, A is a radical selected from the group consisting of the —OR', —OOCR' and $$-\overset{O}{\overset{\|}{C}}OR'$$

radicals wherein R' is a radical free of aliphatic unsaturation selected from the group consisting of hydrocarbon and hydrocarbonoxy radicals, the A radical containing a total of less than eleven atoms, a has an average value of from 0 to 1, n has an average value of from 6 to 420, d has an average value of from 0 to 30, b has an average value from 1 to 30 and c has an average value from 3 to 30, said copolymers containing at least 13 percent by weight $OSiMe_2$ units based on the weight of the copolymer.

It will be apparent from the foregoing that many other variations and modifications may be made in the structures, compounds, compositions, and methods described herein without departing substantially from the essential features and concepts of the present invention. Accordingly, it should be clearly understood that the forms of the invention described herein are exemplary only and are not intended as limitations on the scope of the present invention.

That which is claimed is:

1. A softening composition comprising a mixture of a fabric softening conditioning compound, which is a cationic compound selected from the group consisting of quaternary ammonium salts and organic based compounds having $C_{12}$ to $C_{18}$ hydrocarbon chain molecules of amines, esters, acids or amine oxides a polydimethylsiloxane polymer having the formula:

$$H_3C-\underset{CH_3}{\overset{CH_3}{Si}}-O(-\underset{CH_3}{\overset{CH_3}{Si}}-O)_x-\underset{CH_3}{\overset{CH_3}{Si}}-CH_3$$

where x is an integer of from one to about one hundred thousand, and a polyoxyalkylene siloxane copolymer, the copolymer being selected from the group consisting of copolymers having the average structural formulae:

(1) $R_aSi[(OSiMe_2)_nOSiMe_2G]_4$, (2) $GMe_2Si(OSiMe_2)_n(OSiMeG)_bOSiMe_2G$, (3) $Me_3Si(OSiMe_2)_n(OSiMeG)_cOSiMe_3$, (4) $R_aSi[(OSiMe_2)_n(OSiMeG)_cOSiMe_3]_4$, (5) $R_aSi[(OSiMe_2)_n(OSiMeG)_dOSiMe_2G]_3$, (6) $R_aSi[(OSiMe_2)_n(OSiMeG)_cOSiMe_3]_3$, in which formulae $R_a$ is a hydrocarbon radical free of aliphatic unsaturation and contains from 1 to 10 carbon atoms, Me is a methyl radical, G is a radical of the structure $—D(OR'')_mA$ wherein D is an alkylene radical containing from 1 to 30 carbon atoms, R'' is composed of ethylene radicals and radicals selected from the group consisting of propylene and butylene radicals, the amount of ethylene radicals relative to the other alkylene radicals being such that the ratio of carbon atoms to oxygen atoms in the total OR'' blocks ranges from 2.3:1 to 2.8:1, m has an average value from 7 to 100, A is a radical selected from the group consisting of the —OR', —OOCR' and $$-\overset{O}{\overset{\|}{C}}OR'$$

radicals wherein R' is a radical free of aliphatic unsaturation selected from the group consisting of hydrocarbon and hydrocarbonoxy radicals, the A radical containing a total of less than eleven atoms, n has an average value of from 6 to 420, d has an average value of from 1 to 30, b has an average value from 1 to 30 and c has an average value from 3 to 30, said copolymers containing at least 13 percent

2. The composition of claim 1 wherein the fabric softening conditioning compound is a quaternary ammonium salt compound of distearyl dimethyl ammonium chloride.

3. The composition of claim 1 wherein the weight ratio of the polymer to the copolymer is from one to three, to three to one.

4. The composition of claim 3 wherein the weight ratio of the polymer to the copolymer is one to one.

5. The composition of claim 4 wherein the softening composition contains from two percent to ten percent by weight of the polymer and the copolymer based on the total weight of the composition.

6. The composition of claim 3 wherein x is an integer of about six hundred and the nominal viscosity of the polymer is about five thousand centistokes measured at twenty-five degrees centigrade.

7. The composition of claim 6 wherein the copolymer has a nominal viscosity of about fifteen hundred centistokes measured at twenty-five degrees centigrade.

8. The composition of claim 7 characterized in that the softening composition is in the form of granules.

9. A particulate fabric laundering detergent formulation comprising at least one organic surfactant selected from the group consisting of anionic, nonionic, ampholytic, and zwitterionic compounds and mixtures thereof, at least one detergent builder selected from the group consisting of inorganic and organic water soluble builder salts, water insoluble builder salts, and seeded builders, and a mixture of a water dispersible fabric softening conditioning compound, which is a cationic compound selected from the group consisting of quaternary ammonium salts and organic based compounds having $C_{12}$ to $C_{18}$ hydrocarbon chain molecules of amines, esters, acids or amine oxides a polydimethylsiloxane polymer having the formula:

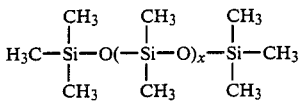

where x is an integer of from one to about one hundred thousand, and a polyoxyalkylene siloxane copolymer, the copolymer being selected from the group consisting of copolymers having the average structural formulae:

(1) $R_aSi[(OSiMe_2)_nOSiMe_2G]_4$, (2) $GMe_2Si(OSiMe_2)_n(OSiMeG)_bOSiMe_2G$, (3) $Me_3Si(OSiMe_2)_n(OSiMeG)_cOSiMe_3$, (4) $R_aSi[(OSiMe_2)_n(OSiMeG)_cOSiMe_3]_4$, (5) $R_aSi[(OSiMe_2)_n(OSiMeG)_dOSiMe_2G]_3$, (6) $R_aSi[(OSiMe_2)_n(OSiMeG)_cOSiMe_3]_3$, in which formulae R is a hydrocarbon radical free of aliphatic unsaturation and contians from 1 to 10 carbon atoms, Me is methyl radical, G is a radical of the structure $—D(OR'')_mA$ wherein D is an alkylene radical containing from 1 to 30 carbon atoms, R′ is composed of ethylene radicals and radicals selected from the group consisting of propylene and butylene radicals, the amount of ethylene radicals relative to the other alkylene radicals being such that the ratio of carbon atoms to oxygen atoms in the total OR″ blocks ranges from 2.3:1 to 2.8:1, m has an average value from 7 to 100, A is a radical selected from the group consisting of the —OR′, —OOCR′ and

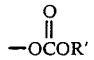

radicals wherein R′ is a radical free of aliphatic unsaturation selected from the group consisting of hydrocarbon and hydrocarbonoxy radicals, the A radical containing a total of less than eleven atoms, n has an average value of from 6 to 420, d has an average value of from 1 to 30, b has an average value of from 1 to 30 and c has an average value of from 3 to 30, said copolymers containing at least 13 percent by weight $OSiMe_2$ units based on the weight of the copolymer.

10. The formulation of claim 9 characterized in that it contains from about ninety to about ninety-eight percent by weight of the surfactant and the detergent builder, and from about two to about ten percent by weight of the mixture of water despersible fabric softening conditioning compound, the polymer and copolymer.

11. The formulation of claim 9 wherein the fabric softening conditioning compound is a quaternary ammonium salt compound of distearyl dimethyl ammonium chloride.

12. The formulation of claim 9 wherein the weight ratio of the polymer to the copolymer is from one to three, to three to one.

13. The formulation of claim 12 wherein the weight ratio of the polymer to the copolymer is one to one.

14. The formulation of claim 13 including from 0.05 percent to 1.0 percent by weight of the polymer and the copolymer based on the total weight of the formulation.

15. The formulation of claim 12 wherein x is an integer of about six hundred and the nominal viscosity of the polymer is about five thousand centistokes measured at twenty-five degrees centigrade.

16. The formulation of claim 15 wherein the copolymer has a nominal viscosity of about fifteen hundred centistokes measured at twenty-five degrees centigrade.

* * * * *

UNITED STATES PATENT AND TRADEMARK OFFICE

CERTIFICATE OF CORRECTION

PATENT NO. : 4,846,982

DATED : July 11, 1989

INVENTOR(S) : Linda M. Madore and Alan Zombeck

It is certified that error appears in the above-identified patent and that said Letters Patent is hereby corrected as shown below:

In column 12, the last line of Claim 1 should read ---containing at least 13 percent by weight $OSiMe_2$ units based on the weight of the copolymer.---

Signed and Sealed this

Twelfth Day of May, 1992

*Attest:*

DOUGLAS B. COMER

*Attesting Officer*

*Acting Commissioner of Patents and Trademarks*